United States Patent [19]

Romanowski et al.

[11] Patent Number: 4,784,345

[45] Date of Patent: Nov. 15, 1988

[54] APPARATUS FOR AUTOMATICALLY ROLLING UP OUTPUT SHEETS FROM A DOCUMENT REPRODUCTION SYSTEM

[75] Inventors: Robert F. Romanowski, Rochester; Raymond E. Poehlein, Fairport, both of N.Y.

[73] Assignee: Xerox Corporation, Stamford, Conn.

[21] Appl. No.: 98,825

[22] Filed: Sep. 21, 1987

Related U.S. Application Data

[63] Continuation-in-part of Ser. No. 075,509, Jul. 20, 1987, abandoned.

[51] Int. Cl.[4] ..... B65H 18/16

[52] U.S. Cl. ..... 242/66; 242/67.2; 242/DIG. 3

[58] Field of Search ..... 242/66, 65, FIG. 3, 242/67.1 R, 67.2, 192

[56] References Cited

U.S. PATENT DOCUMENTS

| | | | |
|---|---|---|---|
| 2,398,879 | 4/1946 | Bouget | 242/66 |
| 2,551,866 | 5/1951 | Bevins et al. | 242/67.2 |
| 2,849,191 | 2/1955 | Gadler | 242/56 R |
| 3,052,073 | 6/1959 | Johansen et al. | 53/118 |
| 3,077,316 | 2/1963 | Wells et al. | 242/DIG. 3 |
| 3,498,559 | 3/1970 | Sames | 242/66 X |
| 4,002,308 | 1/1977 | Feighery | 242/66 |
| 4,067,567 | 1/1978 | McNeil | 242/DIG. 3 |
| 4,102,512 | 7/1978 | Lewallyn | 242/66 |
| 4,494,706 | 1/1985 | Becherer | 242/67.1 R |

FOREIGN PATENT DOCUMENTS

| | | | |
|---|---|---|---|
| 2758143 | 6/1979 | Fed. Rep. of Germany | 242/66 |

*Primary Examiner*—John M. Jillions

[57] ABSTRACT

A copying/printing machine is adapted for rolling up copies of large size documents such as engineering drawings and the like by incorporating a roll-up apparatus into the machine. An output copy is guided along a circular interior space formed by a combination of curved baffle members. The copy is propelled along a spiraling inward path by a combination of feed rollers and nudging rollers spaced along the width of the baffle members. A portion of the roll-up apparatus is pivotable downward to permit the rolled-up output document to be removed.

5 Claims, 4 Drawing Sheets

APPARATUS FOR AUTOMATICALLY ROLLING UP OUTPUT SHEETS FROM A DOCUMENT REPRODUCTION SYSTEM

BACKGROUND AND PRIOR ART STATEMENT

This application is a continuation-in-part of copending U.S. Ser. No. 075,509 filed on July 20, 1987 and abandoned Feb. 17, 1988. The present invention relates to a device for automatically rolling up large paper sheets and, more particularly, to an apparatus positioned at the output station of a document reproduction machine which guides the output sheets into tubular form by means of a plurality of rollers and baffles.

There are a number of prior art applications wherein the configuration of a flat article, following a manufacturing or production step, is required to be transformed into a tubular form for convenient removal from a work station. U.S. Pat. Nos. 4,002,308 and 4,102,512 disclose a roll-up mechanism comprising four rollers which define a center aperture in which cut carpet sections of various lengths are rolled up. U.S. Pat. No. 2,849,191 discloses an apparatus for winding paper material into rolls. The apparatus includes two input rollers and two roll-up stations where the sheets are rolled within a central aperture formed between rolled sets. Upon completing the roll-up operation, the paper rolls automatically fall into a container. U.S. Pat. No. 3,052,073 shows a cluster of rollers which form a space therebetween in which sheets are wound. As the rolled sheet diameter expands, bottom rollers are moved away to allow rolled sheets to be removed.

Document reproduction machines capable of copying up to 36" long engineering drawings are known in the art; the Xerox 2510 copier being one example. The requirements for obtaining a tightly rolled copy of an engineering drawing are very demanding and require a roll-up mechanism which provides rolled-up drawings of exactly the same diameter. The prior art devices which utilize clusters of rollers to define a central rollup area do not require such precise roll-up requirements. The present invention is, therefore, directed towards an apparatus for guiding a large sheet of material into a roll-up area in which the sheet is rolled into a tubular form of precisely defined diameter. More particularly, the invention is directed towards an apparatus for rolling copy sheets into a tubular roll, the apparatus including:

means for accepting said copy sheets from the output station of a document reproduction machine and for feeding said sheets into a roll-up station, the roll-up station including;

a cylindrical housing formed by a plurality of curved baffle members having apertures therethrough;

a plurality of rollers arranged around the circumference of said housing, a portion of the outer surface of said rollers seated in said apertures and extending a short distance into the interior of said housing;

said rollers adapted to be driven in the same direction whereby, as a sheet is moved into said housing by said feeding means, the sheet is guided by said baffles and urging rollers and wound into a tubular form.

BRIEF DESCRIPTION OF THE DRAWINGS

Referring to FIG. 1 of the drawings, there is shown a xerographic type reproduction machine 8 and a sheet roll-up apparatus 10. Machine 8 has a suitable frame 12 on which the machine xerographic components are operatively supported. Briefly, and as will be familar to those skilled in the art, the machine xerographic components include a recording member, shown here in the form of a rotatable drum 14 having a photoconductive surface. Other photoreceptor types such as a belt or web may instead be contemplated. Operatively disposed about the periphery of photoreceptor 14 is charge corotrom 18 for placing a uniform charge on the photoconductive surface of photoreceptor 14, an exposure station 20 where the previously charged photoconductive surface is exposed to image rays of the document 9 being copied or reproduced, development station 24 where the latent electrostatic image created on the photoconductive surface is developed by toner, transfer station 28 with transfer corotrons 29, 30 for transferring the developed image to a suitable copy substrate material such as a copy sheet 32 brought forward in timed relation with the developed image on photoconductive surface, cleaning station 34 and discharge corotron 36 for removing leftover developer from the photoconductive surface and neutralizing residual charges thereon.

Figure 1:
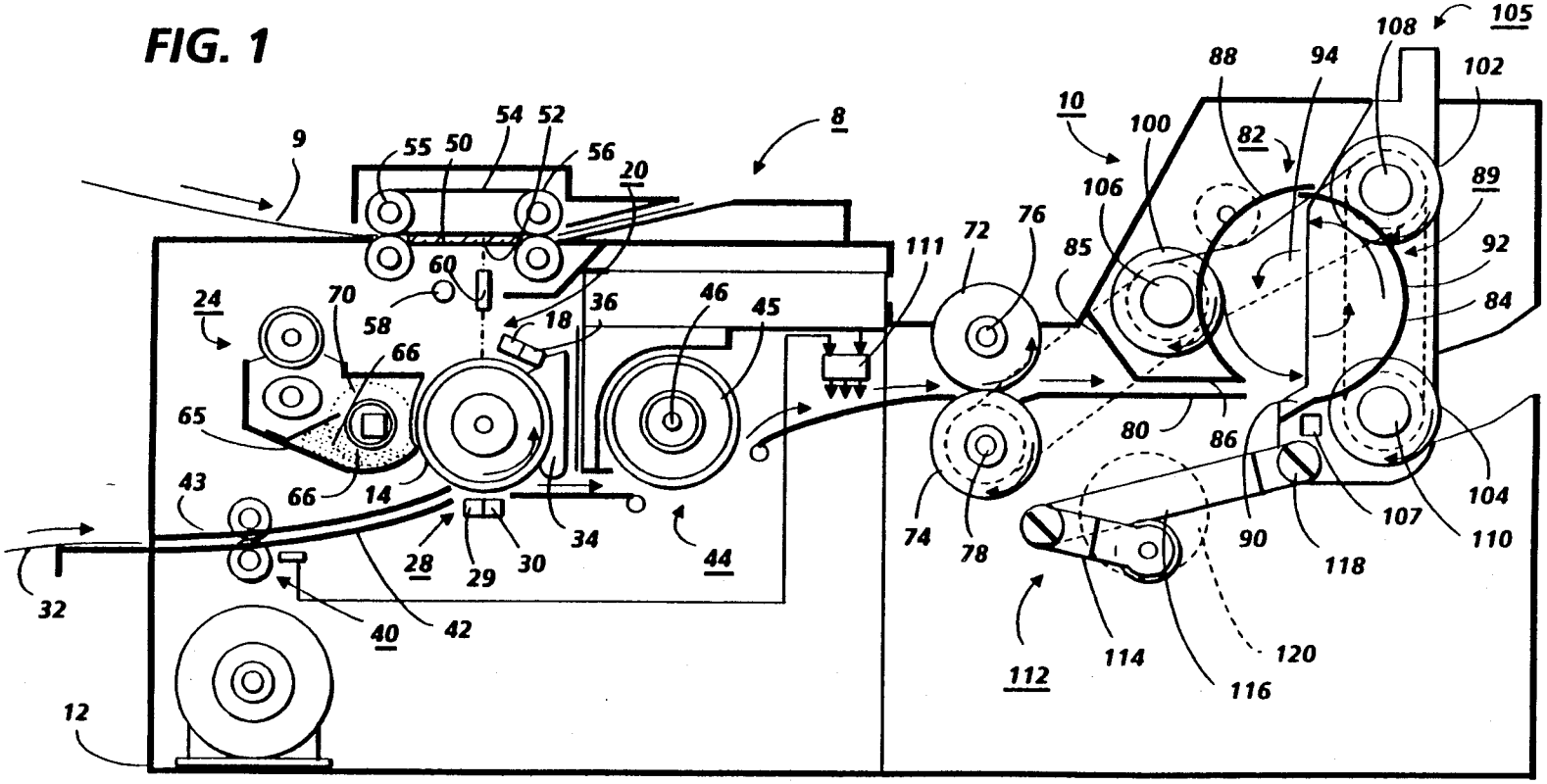
FIG. 1 is a side view of a document reproduction machine incorporating the output sheet roll-up apparatus of the present invention.
Figure 2:
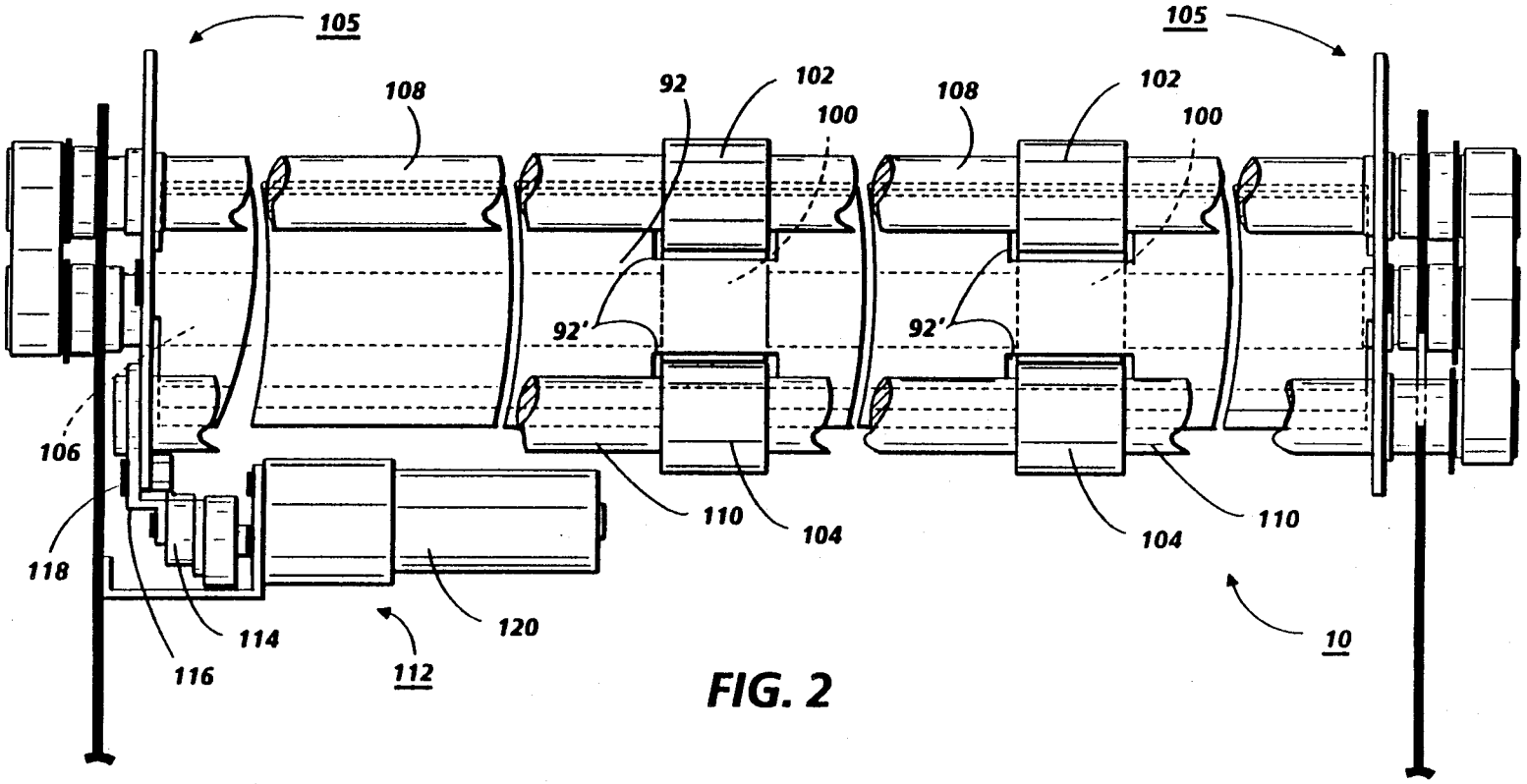
FIG. 2 is a frontal view of the sheet roll-up apparatus of FIG. 1.

Copy sheets 32 are brought forward to transfer station 28 by feed roll pair 40 and sheet guides 42, 43. Following transfer, the sheet 28 is carried forward to a fusing station 44 where the toner image is fixed by fusing roll 45. Fusing roll 45 is heated by a suitable heater such as lamp 46 disposed within the interior roll 45. After fixing, the copy sheet 32 enters the document roll-up apparatus 10 whose operation is described in detail below.

Continuing with the description of machine 8, transparent platen 50 supports the document 9 as the document is moved past a scan point 52 by a constant velocity type transport 54. As will be understood, scan point 52 is, in effect, a scan line extending across the width of platen 50 at a desired point where the document is scanned line by line. Transport 54 has input and output document feed roll pairs 55, 56 respectively on each side of scan point 52 for moving document 9 across platen 50 at a predetermined speed. Exposure lamp 58 is provided to illuminate a strip-like area of platen 50 at scan point 52. The image rays from the document line scanned are transmitted by a gradient index fiber lens array 60 to exposure station 20 to expose the photoconductive surface of the moving photoreceptor 14.

Developing station 24 includes a developer housing 65, the lower part of which forms a sump 66 for holding a quantity of developer. As will be understood by those skilled in the art, the developer comprises a mixture of larger carrier particles and smaller toner or ink particles. A rotatable magnetic brush developer roll 70 is disposed in predetermined operative relation to the photoconductive surface. In developer housing 65, roll 70 serving to bring developer from sump 66 into developing relation with photoreceptor 14 to develop the latent electrostatic images formed on the photoconductive surface thereof.

Figure 3:
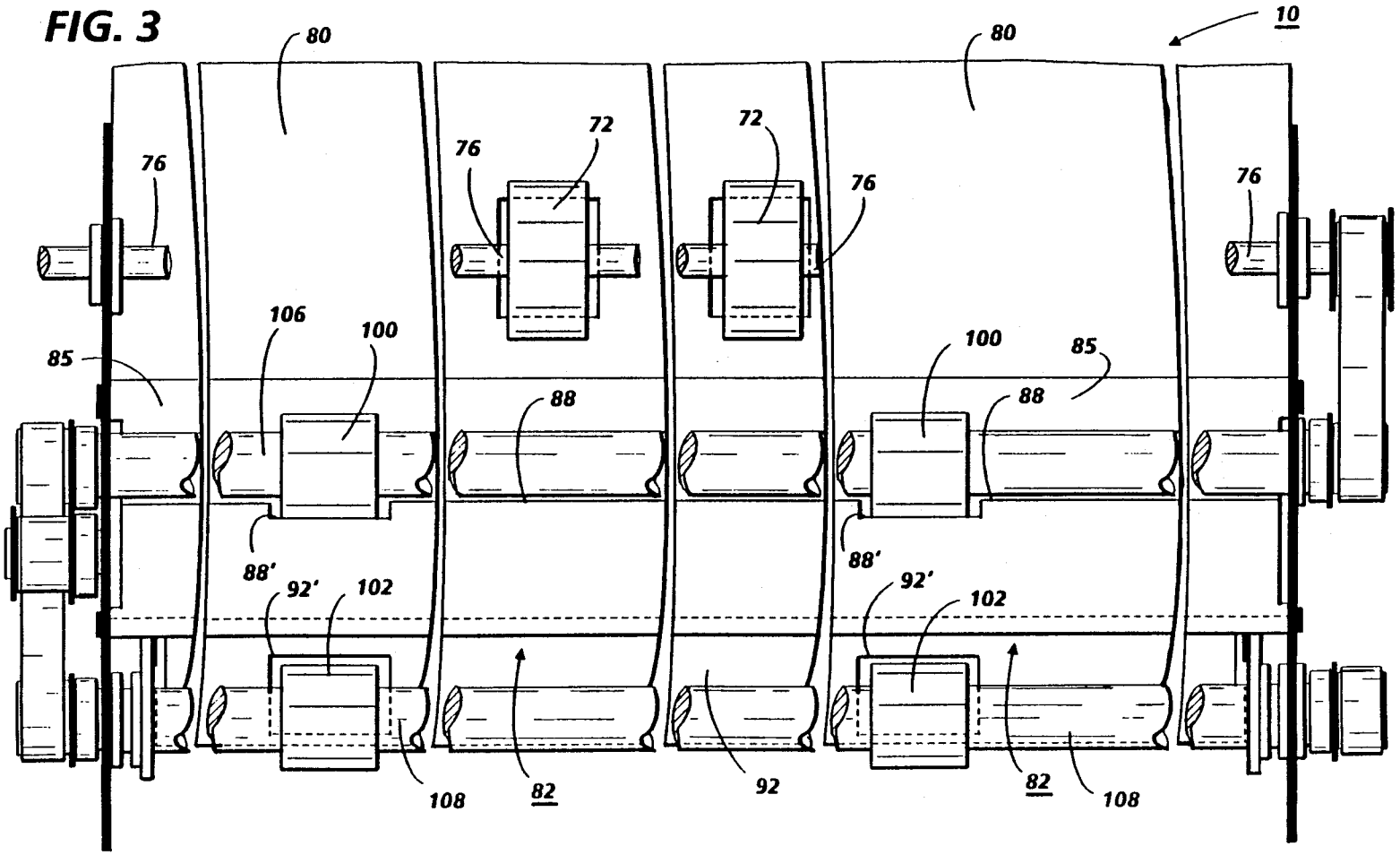
FIG. 3 is a top view of the sheet roll-up apparatus.

Turning now to the roll-up apparatus 10, shown in side view in the right hand portion of FIG. 1, in a full width front view in FIG. 1 and in a top view in FIG. 3, there is shown two sets of feed rollers 72, 74 which engage the leading edge of sheet 32 as it emerges from the fusing station 44. Feed roller sets 72 and 74 comprise a plurality of rollers, a preferred number being two, which are driven in the indicated direction. The rollers are mounted on shafts 76, 78 which are driven by drive motors (not shown). The sheet is guided by baffle members 80, 82 and 89 all of which present relatively smooth surfaces to the moving sheets. Baffle member 82 has an upward inclination 85 at the left end with a straight section 86 from left of center position to the right end (viewed from FIG. 1 perspective) and a curved section 88 forming a portion of a circular roll-up area. Baffle member 80 comprises a flat section which forms a parallel guideway with section 86 of baffle 82. Baffle member 89 has a straight left section 90 and a curved right section 92. Curved sections 88 and 92 enclose a central, roll-up area 94 therebetween. Baffle sections 88 and 92 are further characterized as having a plurality of apertures 88' and 92', formed at intervals along their length. These apertures are of sufficient width and length to accommodate a portion of roller sets 100, 102 and 104 seated therein. As shown, a small chord of each roller protrudes a short distance into the interior of central roll-up area 94. Roller sets 100, 102, 104 are mounted on shafts 106, 108, 110, respectively and driven in the indicated direction by motor means (not shown). Baffle member 92 and roller sets 102, 104 are further characterized as forming an assembly 105 which is pivotable upward in a counterclockwise direction for purposes described below.

Figure 4:
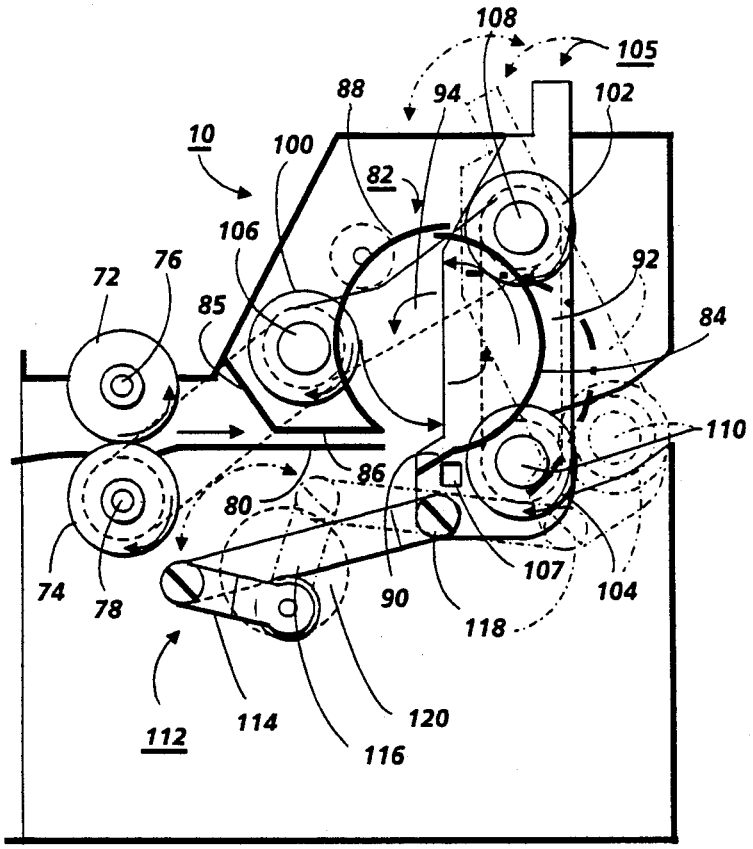
FIG. 4 is a side view of the sheet roll-up apparatus of FIG. 1 pivoted to a document release position.

The operation of the roll-up apparatus 10 will now be described. As a large size copy sheet emerges from the fusing station 44, its leading edge is engaged by rollers 72, 74 and the sheet is fed into the relatively wide space formed by the diverging left ends of baffle members 80, 82. As the sheet progresses from left to right, it is guided into the narrow guideway formed between the flat sections of the baffles. As the leading edge of the sheet emerges from the guideway, it is guided in an upward counterclockwise arc by the curved right end 92 of baffle member 84 and by the action of roller set 104. The sheet is urged to continue its upward curved path by the action of roller set 102. The sheet, now being propelled by feed roll set 72, 74 and roller sets 102, 104 continues to slide along the surface of baffle member 92, until it encounters roller set 100. These rollers contribute to the continued motion of the sheet which has now assumed a spiraling motion. The leading edge of the sheet completes a complete spiral revolution as the leading edge contacts an intermediate portion of the still advancing copy sheet. At this point, the first "ring" of the rolled up document has been established. The roll-up, spiraling action will continue in the same manner with the roll being slightly compressed inward with the addition of each new "ring" following a complete revolution. In a preferred embodiment, the roller sets are made of a foam material to allow compression to accommodate additional "rings". As the trailing edge of the copy sheet passes photosensor 111, a delayed signal is sent to pivot assembly 112. Assembly 112 consists of a crank 114 and link 116 connected to a fixed point 118, on the lower left edge of assembly 105. Following a time interval during which the trailing edge of the sheet has entered the central roll-up area 94, a signal is sent to motor 120 which drives attached crank 114 in a clockwise direction. A force is applied in a similar direction to assembly 105, pivoting the assembly to the dotted line position shown in FIG. 4. The rolled-up output copy is then free to drop through the space formerly occupied by the lower position of the assembly.

In order to assist the sliding, spiraling action during the roll-up operation, the interior surfaces of baffle members 80, 82 and 92 may have irregularly spaced ribbed surfaces, the ribs running parallel to the process direction. As an additional feature, it may be desirable for some systems to roll the documents in such a way that the information is visible on the outside of the rolled-up document. This can be accomplished by reversing the relative position of the fuser and document feed roller 40 position in FIG. 1 as by inserting a document inverting device between the fuser output and feed rollers 72, 74.

Figure 5:
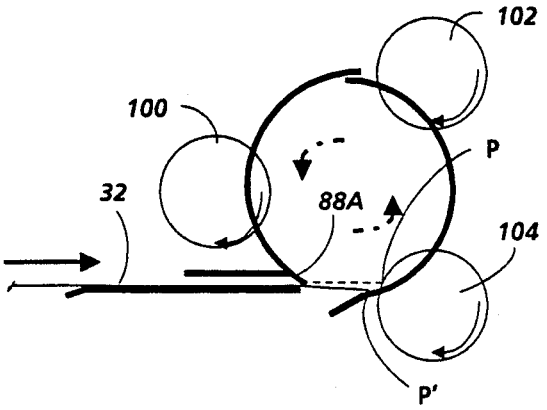
FIG. 5 is a side view of a second embodiment of the sheet roll-up apparatus.

FIG. 5 shows a modification of roll-up apparatus 10 in which curved section 88 of baffle member 82 has been extended by adding extension 88A. The effect of this extension is to provide a downward force on sheet 32 as it is conveyed into the entrance of the roll-up apparatus. This downward force reduces any corrugation that may exist across the sheet lead edge. Any such corrugation, if not reduced, makes rolling up of the sheet difficuly. The downward force also redirects the sheet in a more favorable direction. The dotted line shows the path the paper would take in the FIG. 1 embodiment contacting roller 104 at point P. With the addition of segment 88A, sheet 32 contacts curved section 92 at a lower point P' and in a more tangential direction thereby lessening the tendency of a sheet to buckle if it follows the more nearly horizontal dotted path.

While the invention has been described with reference to the structure disclosed, it is not confined to the details set forth, but is intended to cover such modifications or changes as may come within the scope of the following claims:

What is claimed is:

1. Apparatus for rolling copy sheets into a tubular roll, the apparatus including:

means for accepting said copy sheets from an output station and for feeding said sheets into a roll-up station, the roll-up station including;

a cylindrical housing formed by a plurality of curved baffle members having apertures therethrough;

a plurality of rollers arranged around the circumference of said housing, a portion of the outer surface of said rollers seated in said apertures and extending a short distance into the interior of said housing;

said rollers adapted to be driven in the same direction whereby, as a sheet is moved into said housing by said feeding means, the sheet is guided by said baffles and urging rollers and would into a tubular form.

2. The apparatus of claim 1 wherein said plurality of curved baffle members comprises a first fixed group of baffle members and a second, pivotable baffle member and said plurality of rollers comprises a first group of fixed rollers and a second group of rollers adapted for pivotal movement in conjunction with said second baffle whereby when said roll-up operation is completed, said pivotable member is pivoted so as to permit the rolled-up output to be removed.

3. The apparatus of claim 1 wherein the interior surface of said curved baffle members has a ribbed configuration.

4. The apparatus of claim 1 wherein said rollers are of foam construction.

5. The apparatus of claim 1 wherein at least one of said baffle members contacts the leading edge of said copy sheet providing a downward guiding force on the sheet causing the sheet to contact a second curved member in a generally tangential direction.

* * * * *